United States Patent [19]

Shudo et al.

[11] Patent Number: 4,559,888

[45] Date of Patent: Dec. 24, 1985

[54] SHIP FOR TRANSPORTING COAL SLURRY

[75] Inventors: Yasunobu Shudo; Masayoshi Kano; Tatsuya Murahashi; Yasuo Nakai; Kazuyoshi Hosogaya, all of Osaka, Japan

[73] Assignee: Hitachi Shipbuilding & Engineering Co., Ltd., Osaka, Japan

[21] Appl. No.: 388,233

[22] Filed: Jun. 14, 1982

[30] Foreign Application Priority Data

| | | | |
|---|---|---|---|
| Jun. 16, 1981 | [JP] | Japan | 56-93451 |
| Jun. 16, 1981 | [JP] | Japan | 56-89136[U] |
| Dec. 8, 1981 | [JP] | Japan | 56-183013[U] |
| Dec. 9, 1981 | [JP] | Japan | 56-183925[U] |
| Dec. 23, 1981 | [JP] | Japan | 56-196331[U] |
| Mar. 31, 1982 | [JP] | Japan | 57-47646[U] |
| Mar. 31, 1982 | [JP] | Japan | 57-47644[U] |
| Mar. 31, 1982 | [JP] | Japan | 57-47645[U] |

[51] Int. Cl.[4] ..... B63B 25/08

[52] U.S. Cl. ..... 114/74 R; 114/72

[58] Field of Search ..... 114/74 R, 73, 26, 72, 114/74 A; 414/140; 210/242.1, 258, 416.1, 172

[56] References Cited

U.S. PATENT DOCUMENTS

| | | | |
|---|---|---|---|
| 3,766,875 | 10/1973 | Baki | 114/73 |

FOREIGN PATENT DOCUMENTS

| | | | |
|---|---|---|---|
| 36884 | 4/1978 | Japan | 114/74 R |
| 83288 | 7/1978 | Japan | 114/74 R |
| 122247 | 10/1978 | Japan | 210/242.1 |
| 61234 | 5/1981 | Japan | 414/140 |
| 1227328 | 4/1971 | United Kingdom | 114/74 R |

OTHER PUBLICATIONS

British App. #2084257 filed 9-1980, Kano.

*Primary Examiner*—Trygve M. Blix
*Assistant Examiner*—Edwin L. Swinehart
*Attorney, Agent, or Firm*—Armstrong, Nikaido, Marmelstein & Kubovcik

[57] ABSTRACT

A ship for transporting a coal slurry comprising a plurality of holds partitioned by transverse bulkheads, each of the holds being provided with a slurry inlet at an upper portion thereof and drain outlets each equipped with a filter and formed in at least one of surrounding walls defining the hold substantially over the entire height of the wall, each hold being provided outside thereof with a drain sump for collecting the slurry water drawn off from the hold through the drain outlets and drainage means for discharging the slurry water from the drain sump.

1 Claim, 47 Drawing Figures

(d)

(e)

SHIP FOR TRANSPORTING COAL SLURRY

BACKGROUND OF THE INVENTION

The present invention relates to a ship for transporting coal slurry.

Generally coal is transported by land from coal mining areas to loading ports, where it is loaded into ships for transport by sea. To reduce the cost of transport by land and also to assure an efficient loading operation at the port, it is frequent practice in recent years to disperse pulverized coal in water in the mining area to obtain a coal slurry, transport the coal slurry to the port through a pipeline and thereafter load the slurry into a ship also through a pipeline. This method is very advantageous in that coal can be automatically loaded into the ship with use of a floating hose or the like which is supported by a buoy and connected to a facility on the shore without mooring the ship alongside a wharf. However, the usual coal slurry to be loaded into ships by pipelines contains, for example, about 50 to 70% by weight of water, so that the coal slurry is inefficient to transport as it is and requires a prohibitively high transport cost since the amount of coal that can be loaded into the ship is smaller by an amount corresponding to the water content. To enable the ship to transport coal with an improved efficiency, it is required to drain the coal slurry in its holds to the greatest possible extent and thereby load the ship with as much coal as possible. Further as an increasing amount of coal is loaded into the hold, coal particles settle, permitting a portion of the slurry water to collect above the mass of coal particles. Accordingly if the ship rolls while transporting the coal slurry in this state, the overlying portion of slurry water heaves to pose the hazard of pronounced rolling or is likely to strike against the hatch cover or flow out from the hold. Such a problem similarly arises also when the ship rolls during loading. The slurry water collecting above the mass of coal particles during loading must therefore be discharged as promptly as possible in order to eliminate the above objection and to assure an efficient slurry loading operation.

The coal slurry placed into the hole is dewatered generally through drain outlets equipped with a filter and provided in the bottom of the hole, but it is difficult to efficiently discharge from the bottom drain outlets the slurry water which collects above coal particles during loading. Thus the conventional ships for transporting coal slurry have the problem that they are not adapted for an efficient loading operation.

SUMMARY OF THE INVENTION

The main object of the invention is to provide a coal slurry transport ship in which the slurry water collecting above a mass of coal particles during loading can be drained efficiently to ensure an efficient coal loading operation and preclude the foregoing objection that would result from the heaving movement of such slurry water.

To fulfill the above object, the present invention provides a ship for transporting a coal slurry comprising a plurality of holds partitioned by transverse bulkheads, each of the holds being provided with a slurry inlet at an upper portion thereof and drain outlets each equipped with a filter and formed in at least one of surrounding walls defining the hole substantially over the entire height of the wall, each hold being provided outside thereof with a drain sump for collecting the slurry water drawn off from the hold through the drain outlets and drainage means for discharging the slurry water from the drain sump.

DESCRIPTION OF THE PREFERRED EMBODIMENTS

Figure 1:
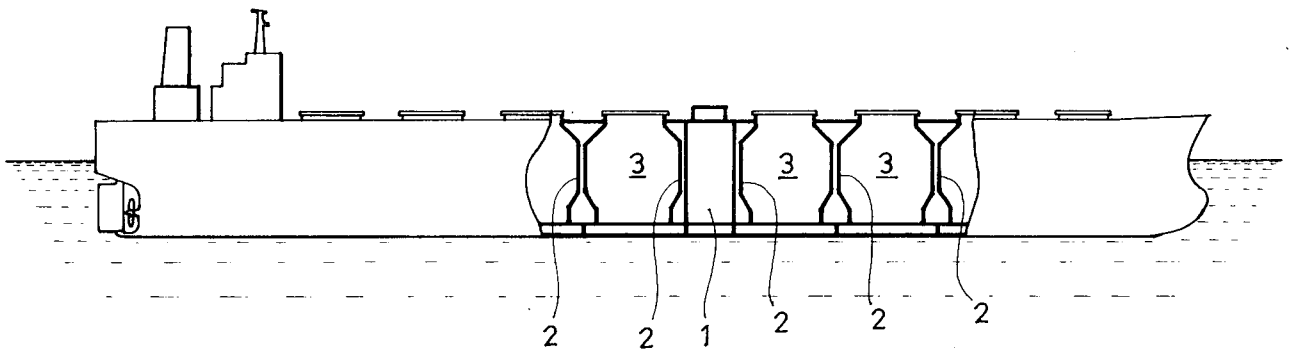
FIG. 1 is a side elevation partly broken away and showing a coal slurry transport ship embodying the invention.
Figure 2:
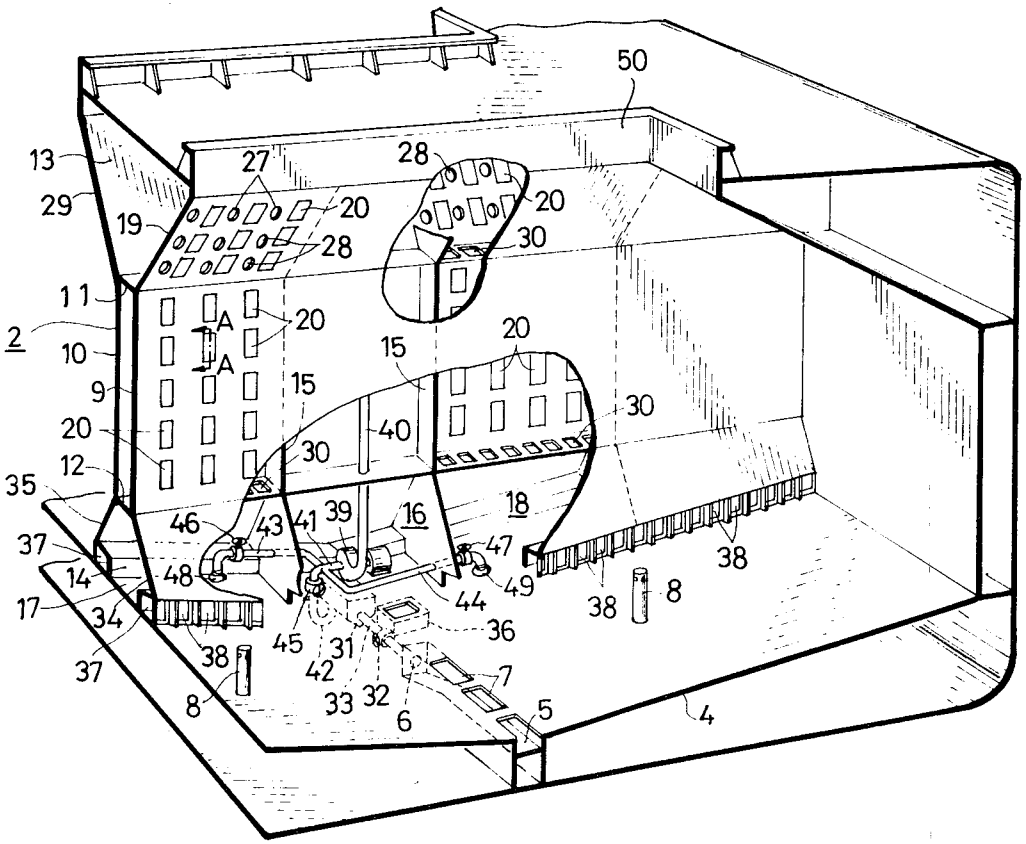
FIG. 2 is a perspective view partly broken away and showing part of a hold of the ship as the interior thereof is seen obliquely from the front.
Figure 3:
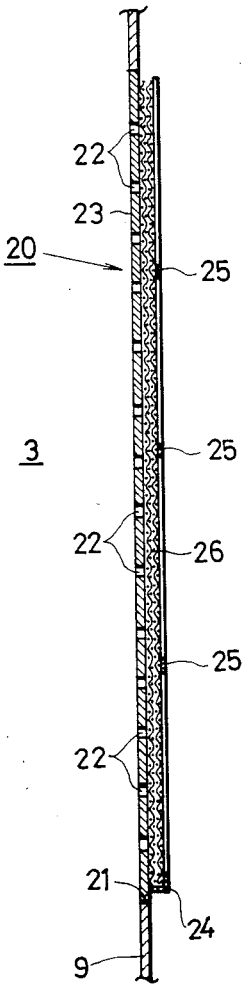
FIG. 3 is an enlarged view in section taken along the line A—A in FIG. 2.
Figure 4:
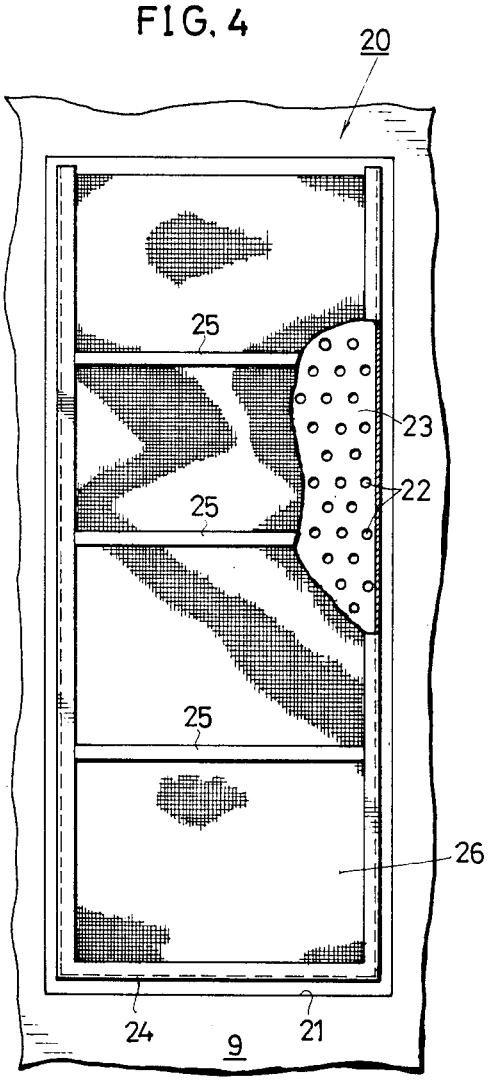
FIG. 4 is a right side elevation of FIG. 3.

FIGS. 1 to 7 show a first embodiment of the invention. The coal slurry transport ship shown in FIG. 1 has a main pump room 1 disposed in the vicinity of its hull and a plurality of holds 3 arranged longitudinally of the hull and partitioned by transverse bulkheads 2 of double construction. As seen in FIG. 2, each of the holds 3 has a double side structure and a double bottom structure including an inner bottom plate which serves as a bottom wall 4. The wall 4 is at a low level along the center line of the hull and is sloped upward toward its opposite sides. The hold 3 is formed in its bottom with a slurry collecting channel 5 extending along the hull center line approximately over the entire length of the hull 3. A recess 6 having a downwardly sloped bottom is formed at each of the front and rear ends of the channel 5. A plurality of apertures 7 are formed in the bottom wall 4 above the channel 5. A suitable number of rotary nozzles 8 are mounted on the hold bottom wall 4. Hopper tanks 13 and 14 partitioned by horizontal walls 11 and 12 are provided above and below front and rear intermediate vertical walls 9 and 10 forming the double transverse bulkhead 2. Each of the space defined by the front and rear vertical walls 9, 10 and the upper and lower hopper tanks 13, 14 is divided into a plurality of sections by vertical walls 15, these sections being arranged transversely of the ship. The section in the midportion of the width of the ship includes a pump room 16 within the lower hopper tank 14. The sections on the opposite sides of the pump room 16 serve as drain sumps 17, 18. The sumps 17 collect drain from the hold 3 in front thereof and will be referred to as "front drain sumps." The sumps 18 collect drain from the hold 3 in the rear thereof and will be referred to as "rear drain sumps." More than one front drain sumps 17 are provided between the pump room 16 and one side of the ship, while a plurality of rear drain sumps 18 are provided between the pump room 16 and the other side of the ship. The sumps 17 and 18 may be arranged transversely of the ship. Overflow drain outlets 20 each having a filter and communicating with the front drain sump 17 are formed in the vertical wall 9 and an upper slanting wall 19 on the front side of the sump 17, as arranged substantially over the entire height of each of the walls. Thus these walls 9, 19 are formed with a large number of vertically elongated openings 21 arranged at a specified spacing vertically as well as horizontally. As seen in FIGS. 3 and 4, a perforated plate 23 having a multiplicity of perforations 22 is fitted in each of the openings 21 and welded to the surrounding portion of the wall. A support frame 24 extending along the opposite side edges of the plate 23 and the lower end thereof and horizontal holding members 25 are fixed to the side of the plate 23 not facing the hold 3. Two superposed sheets of metal netting 26 are inserted from above into the space between the perforated plate 23 and the frame 24 and the holding member 25 and are fixedly positioned to close the perforations 22. The upper slanting wall 19 on the front side of the front drain sump 17 is formed with overflow drain outlets 27 in an upper portion thereof and with closable free water drain outlets 28 below the outlets 27. The vertical wall 10 and an upper slanting wall 29 on the rear side of the rear drain sump 18 are similarly formed with overflow drain outlets 20, 27 and free water drain outlets 28. The upper and lower horizontal walls 11, 12 above the drains sumps 17, 18 are each formed with openings 30. The front drain sumps 17 are held in communication with one another by an unillustrated drain channel to collect drain in the sump 17 adjacent the pump room 16. The same is true of the rear sumps 18. Provided under the pump room 16 of the lower hopper tank 14 is a container 31 for containing the slurry from the holds 3 in front and rear of the room. The rear or front end recess 6 of the slurry collecting channel 5 of each of these holds 3 is held in communication with the slurry container 31 by a pipe 33 having a valve 32. The channel 5 and the pipe 33 are internally provided with nozzles (not shown). The transverse bulkhead 2 includes front and rear lower slanting walls 34, 35 each of which is provided at its lower end with a drain trunk 37 communicating with a bilge well 36 under the pump room 16. The wall of the trunk 37 facing the hold 3 is formed with drain outlets 38 each having a filter. A pump 39 for draining and also for discharging slurry is installed in the pump room 16 and has a discharge pipe 40 connected to the unillustrated pump of the main pump room 1. The pump 39 has an inlet pipe 41 connected to a slurry discharge pipe 42 and to two drain pipes 43, 44. These pipes 42, 43, 44 are provided with valves 45, 46, 47. The slurry discharge pipe 42 is further connected to the lower side of the slurry container 31, while the forward ends of the two drain pipes 43, 44 are disposed within the drain sumps 17, 18 on the opposite sides of the pump room 16. The ends of the drain pipes 43, 44 have bell mouths 48, 49. The front wall 51 of a hatch coaming 50 for the hold has a slurry inlet 52.

Figure 5:
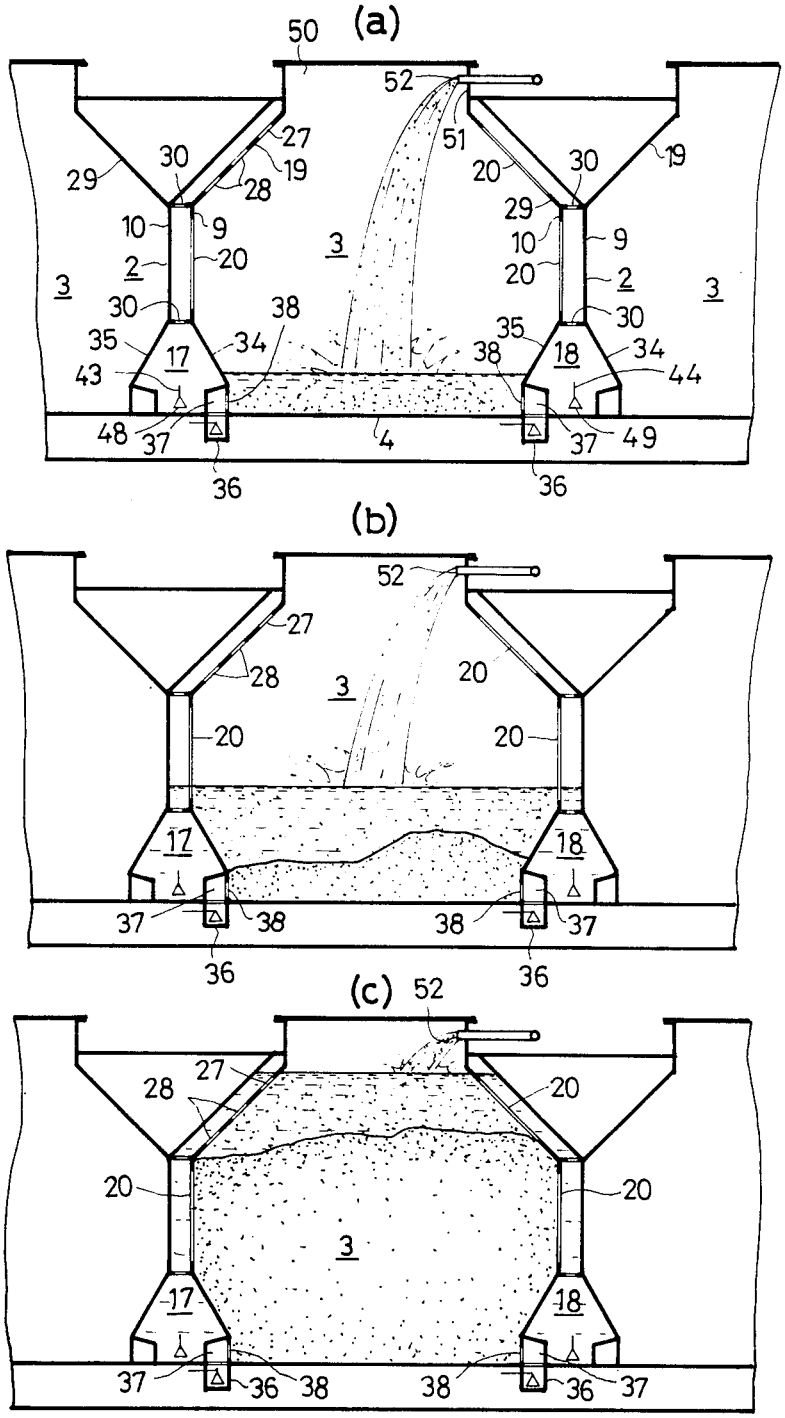
FIG. 5 (*a*) to FIG. 5 (*e*) are views in longitudinal section of the hold for illustrating the procedure of coal slurry loading operation.
Figure 5:
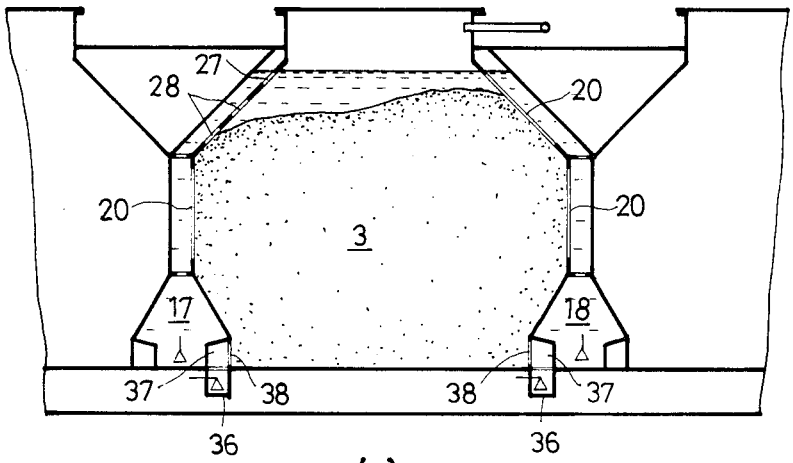
Figure 5:
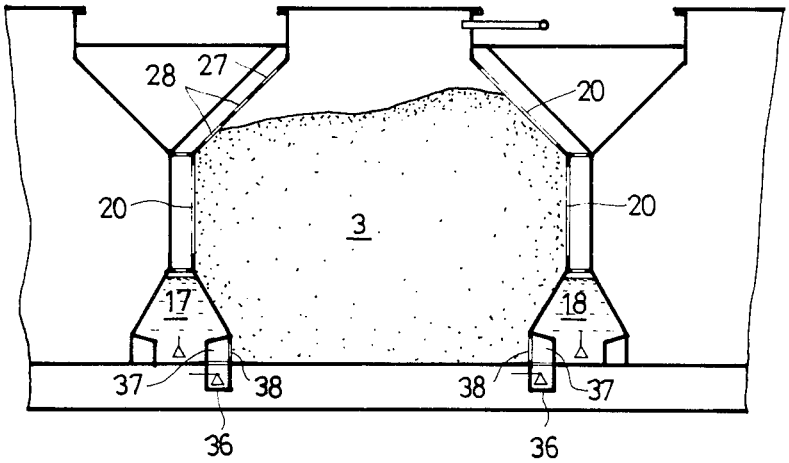

A coal slurry is loaded into the transport ship in the following manner (see FIGS. 5 (*a*) to (*e*)).

The coal slurry contains relatively large coal particles of up to about 50 mm in size. The slurry is continuously placed into each hold 3 from the inlet 52 above the hold (see FIG. 5 (*a*)). The coal particles in the slurry settle in the hold 3, permitting part of the slurry water to collect above the mass of the coal particles (see FIG. 5 (*b*)). Throughout the loading operation, the slurry water partly flows into the drain trunks 37 through the outlets 38 in the rear lower slanting wall 35 of the transverse bulkhead 2 at the front side of the hold 3 and through the outlets 38 in the front lower slanting wall 34 of the transverse bulkhead 2 at the rear side of the hold 3 and collects in the front and rear bilge wells 36 of the hold 3. The water is then discharged by a drain pump (not shown) provided at a suitable location, for example, in the main pump room 1. As the water level of the coal slurry rises with the progress of loading operation, the water collecting above the mass of coal particles is collected in the rear drain sumps 18 through the filter-equipped overflow drain outlets 20 in the front transverse bulkhead 2 of the hold and also in the front drain sumps 17 through the filter-equipped overflow drain outlets 20 in the rear transverse bulkhead 2 of the hold 3. During loading, the valves 32 on the pipes 33 at the front and rear ends of the slurry collecting channel 5 and the valve 45 on the slurry discharge pipe 42 are closed, while the valves 46, 47 on the drain pipes 43, 44 are open. Throughout the loading operation, the slurry water collected in the sumps 17, 18 through the overflow drain outlets 20 is sent to the main pump room 1 by the pump 39 in the pump room 16 and is further returned ashore by the pump in the main pump room 1. The water thus returned ashore is reused for forming a slurry of coal. During loading the height of the deposit of coal particles is monitored. Before the coal reaches the free water drain outlets 28, the outlets 28 are open, and the overflow water is drawn off through the outlets 28 and the overflow drain outlets 27 thereabove and collected in the drain sumps 17, 18 (see FIG. 5 (*c*)). When the top of the coal deposit has reached the free water drain outlets 28, the outlets 28 are closed, causing the overflow water to run off from the overflow drain outlets 27 thereabove. Upon the top of the coal deposit reaching a predetermined level, the loading of coal slurry is discontinued (see FIG. 5 (*d*)). When the coal slurry is allowed to stand in this state, a major portion of the slurry water is drained, permitting the coal and a small amount of water to remain within the hold 3 (FIG. 5 (*e*)). While slurry water remains between the coal particles thus loaded into the hold 3, the water is partly drawn off during navigation through the filter-equipped drain outlets 38 at the lower ends of the lower slanting walls 34, 35 of the transverse bulkheads 2.

Because the coal particles have relatively large sizes and further because the overflow drain outlets 20 are formed in the front and rear transverse bulkheads 2 of each hold 3 substantially over the entire height thereof, the overflow water collecting above the deposit of coal particles can be promptly drawn off into the drain sumps 17, 18. The slurry water can be discharged efficiently from the drain sumps 17, 18 by the pump 39 provided in the pump room 16 of each transverse bulkhead 2. This assures an efficient coal slurry loading operation, further eliminating the foregoing objection that would result from the heaving motion of the slurry water if the ship rolls during loading or navigation. Since the slurry water can be drained efficiently during loading, the ship is loadable with a correspondingly increased amount of coal to achieve an improved transport efficienty. The overflow drain outlets 27 and free water drain outlets 28 having no filter and provided in the upper slanting walls 19, 29 of each transverse bulkhead 2 assure drainage of the overflow water even if the other overflow drain outlets 20 have their filters clogged up.

Figure 6:
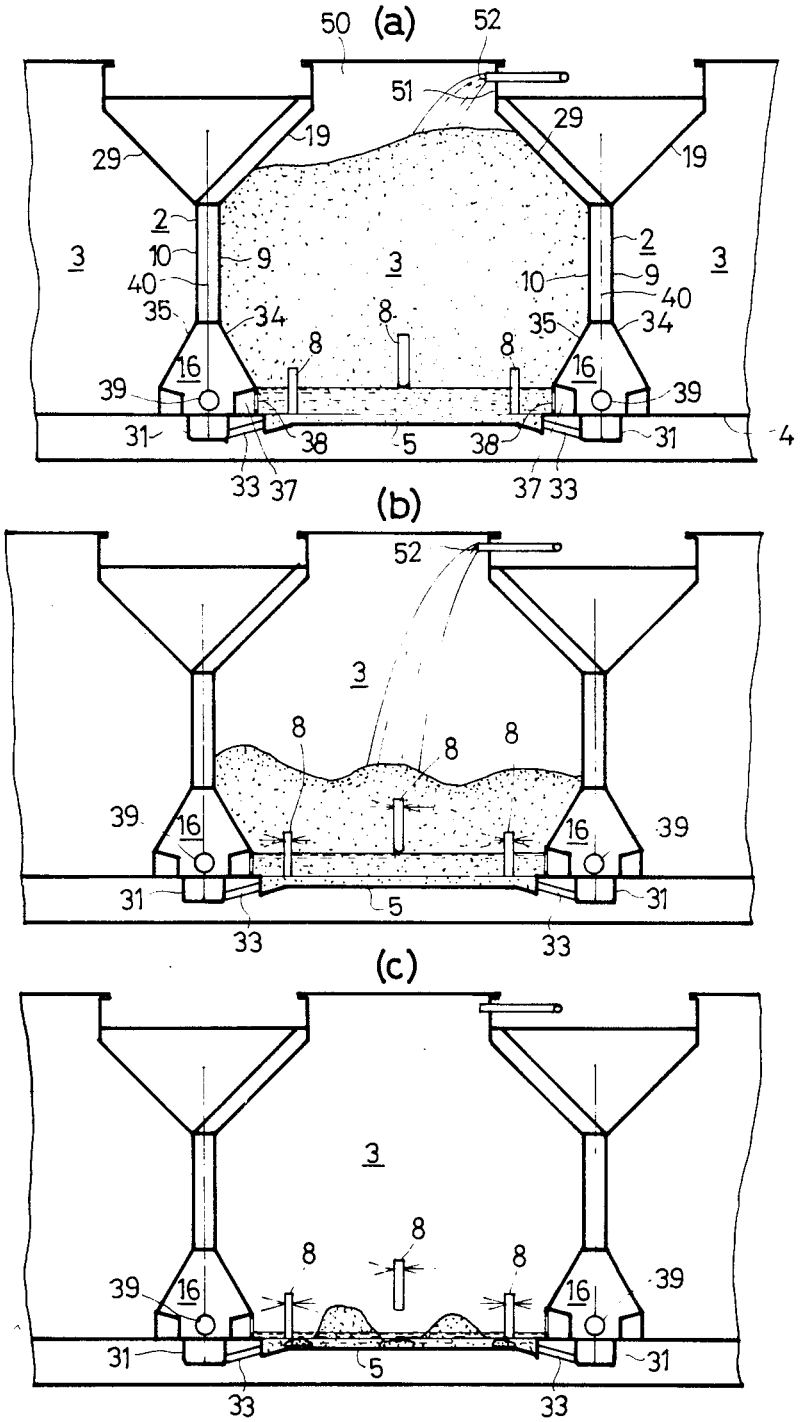
FIG. 6 (*a*) to FIG. 6 (*c*) are views in longitudinal section of the hold for illustrating the procedure of coal slurry unloading operation.
Figure 7:
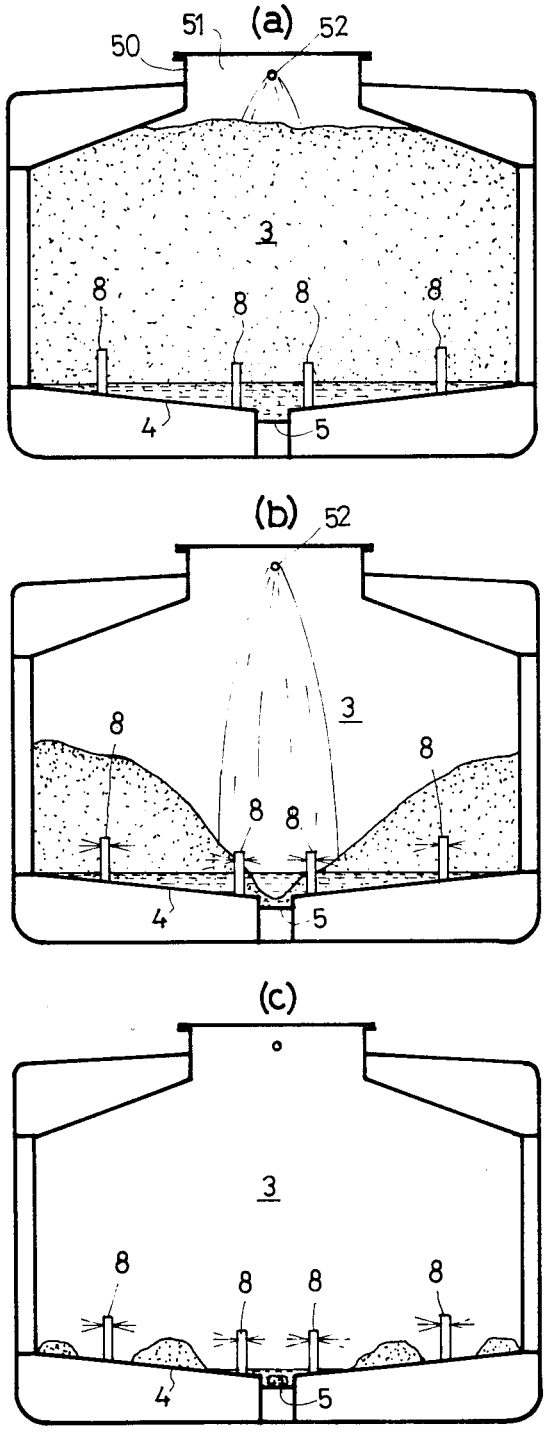
FIGS. 7 (*a*) to (*c*) are cross sectional views of the hold and corresponding to FIGS. 6 (*a*) to (*c*) respectively.

The coal thus loaded into the hold 3 is transported and thereafter reconstituted into a slurry and unloaded in the following manner (FIGS. 6 and 7).

Before unloading, the valves 46, 47 on the drain pipes 43, 44 are closed, the valve 45 on the slurry discharge pipe 42 and the valves 32 on the pipes 33 at the opposite ends of the slurry collecting channel 5 are opened, and the free water drain outlets 28 are closed. Water is then injected through the slurry inlet 52 into the hold 3 to a predetermined level. With the injection of water continued to maintain this water level, the pumps 39 in the front and rear transverse bulkheads 2 are operated to discharge the coal slurry (FIG. 6 (*a*) and FIG. 7 (*a*)). The coal which is reconstituted into a slurry with the application of water falls from the lowermost position into the channel 5 through the apertures 7, passes through the front and rear end recesses 6 of the channel and through the pipes 33 into the front and rear slurry containers 31 of the hold 3 and is sent through the discharge pipes 42 into the main pump room 1 by the pumps 39. The coal slurry is further delivered ashore by the pump in the main pump room 1. When the amount of coal remaining in the hold becomes small, high-pressure water is discharegd from the rotary nozzles 8, whereby the remaining mass of coal is collapsed and collected in the channel 5 and is further discharged in the same manner as above (FIG. 6 (*b*) and FIG. 7 (*b*)). When the amount of remaining coal further reduces, the valve 32 on the pipe 33 at the front end of the channel 5 is closed, and the pump 39 in the front bulkhead 2 of the hold 3 is stopped. The coal is caused to flow down the sloped bottom wall 4 with the high-pressure water from the rotary nozzles 8. High-pressure water is also discharged from the nozzles within the channel 5 and the pipes 33 to force the coal slurry into the rear slurry container 31 of the hold 3, from which the slurry is discharged by the pump 39 (FIG. 6 (*c*) and FIG. 7 (*c*)).

Thus the coal slurry can be discharged efficiently by the use of the pump 39 in each transverse bulkhead 2. The rotary nozzles 8 installed on the sloped bottom wall 4 of the hold make it possible to unload from the hold 3 the coal in the form of a slurry without leaving any remainder.

As described above, the coal slurry transport ship of FIGS. 1 to 7 is equipped with the pumps 39 in the transverse bulkheads 2 for draining the slurry water during loading and for discharging the coal slurry for unloading and therefore has an increased capacity to dewater the slurry for loading and an increased capacity to discharge the slurry for unloading, consequently assuring efficient loading and unloading. Furthermore, the pump room 16 and the drain sumps 17, 18 which are disposed in the void space within the lower hopper tank 14 usually provided in the transverse bulkhead 2 do not decrease the capacity of the hold 3, hence economical.

The wire netting 26 of the filter-equipped overflow drain outlet 20 is attached to the perforated plate 23 on one side thereof not facing the hold 3 and therefore will not be damaged by coal particles. The netting 26 can be cleaned easily by forcing water against the netting with a nozzle from inside the sump 17 or 18 in the bulkhead 2.

The netting support frame 24 and the holding members 25, which are attached to the perforated plate 23 according to the foregoing embodiment, may alternatively be attached to the portion of the wall 9, 10, 19 or 29 defining the opening 21. The wall 9, 10, 19 or 29 may be directly formed with a multiplicity of perforations to serve as a perforated plate, and wire netting may be attached to the side of the wall not facing the hold 3 to provide a filter. Although the transverse bulkhead 2 of the above embodiment originally has a double construction, a corrugated partition may be used with its furrows positioned vertically and covered with a perforated plate to provide filter-equipped overflow drain outlets and drain sumps.

Figure 8:
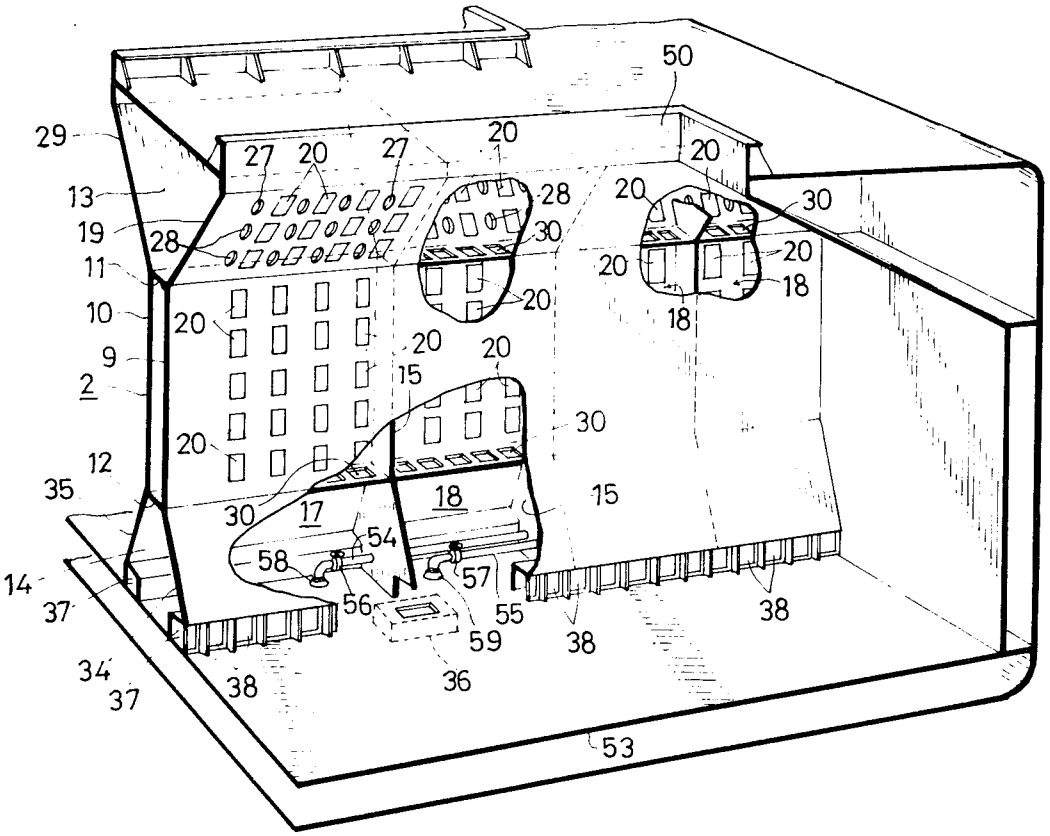
FIG. 8 is a perspective view partly broken away and showing an interior portion of a hold of another embodiment of the invention as seen obliquely from the front.
Figure 9:
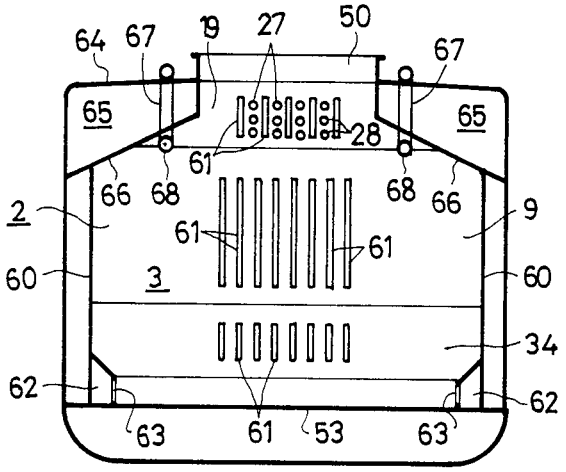
FIG. 9 is a cross sectional view showing another embodiment of the invention.

FIG. 8 shows another embodiment of the invention, in which the same parts as used in the foregoing embodiment are referred to by the same corresponding reference numerals and will not be described.

The hold of the coal slurry transport ship has a bottom plate 53 which is provided by a horizontal inner bottom plate. The interior of each transverse bulkhead 2 is divided into a plurality of sections all of which serve as drain sumps 17 or 18. A plurality of front drain sumps 17 are arranged between the hull center line and one side of the ship, while rear drain sumps 18 are provided between the center line and the other side of the ship. Drain pipes 54, 55 connected to a drain pump (not shown) in a main pump room approximately in the center of the hull have forward ends disposed within the front sump 17 and rear sump 18 respectively. These drain pipes 54, 55 have valves 56, 57 mounted thereon and bell mouths 58, 59 attached to the ends.

A coal slurry is loaded into the above ship in the same manner as in the foregoing embodiment. The slurry water collected in the drain sumps 17, 18 through the overflow drain outlets 20, 27 and free water drain outlets 28 during loading is drawn off through the pipes 54, 55 by the drain pump in the main pump room and sent back ashore. The coal loaded into the holds is unloaded with a grab after transport.

FIGS. 9 to 12 show another embodiment of the invention, wherein the same parts as used in the foregoing embodiments are referred to by the same corresponding reference numerals and will not be described.

Figure 11:
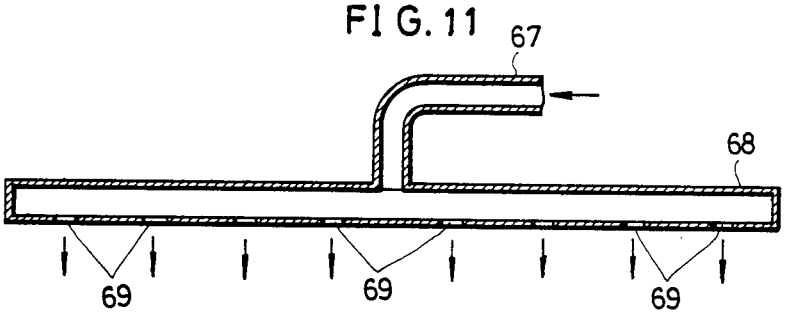
FIG. 11 is a sectional view showing an example of coal slurry distributing pipe included in the embodiment of FIG. 9.
Figure 12:
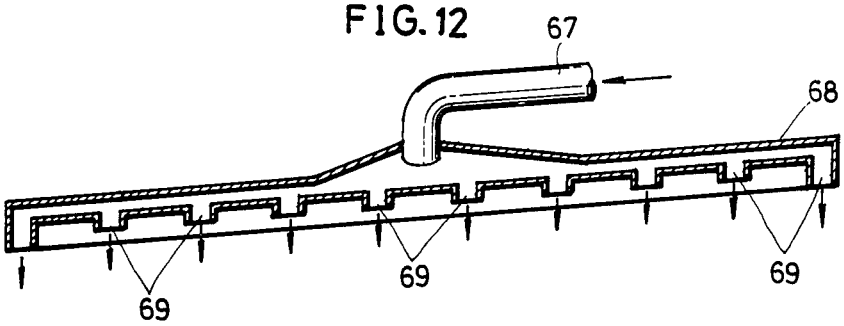
FIG. 12 is a sectional view showing a modified coal slurry distributing pipe.
Figure 10:
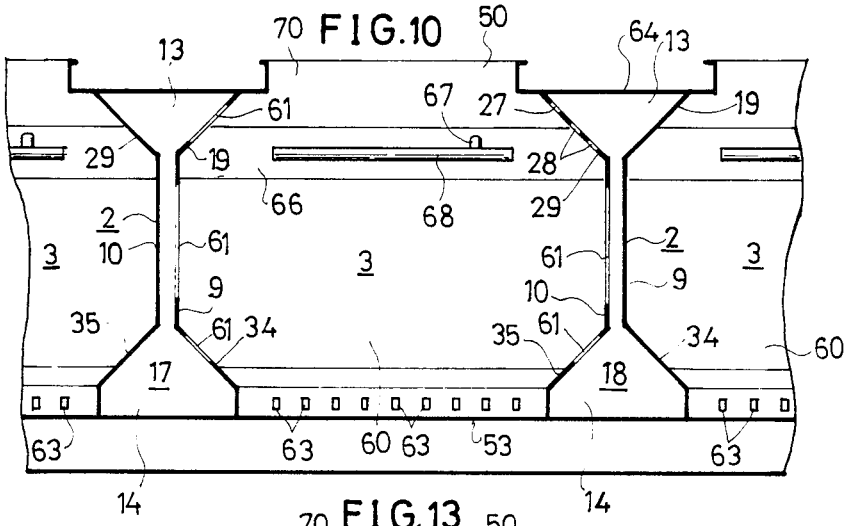
FIG. 10 is a view in longitudinal section showing a hold of the embodiment of FIG. 9.

The hold of the coal slurry transport ship has side walls 60 each comprising an inner side plate of double construction. Each transverse bulkhead 2 internally has front drain sumps 17 and rear drain sumps 18. Overflow drain outlets 61 each having a filter are formed also in the lower slanting wall 34 at the front side of the front sump 17 and in the lower slanting wall 35 at the rear side of the rear drain sump 18. Such outlets 61 are elongated vertically approximately over the entire height of each of the walls 19, 9, 34, 29, 10, 35. A drain trunk 62 is provided at the lower end of each side wall 60 of the hold 3 and formed in the wall thereof facing the hold 3 with drain outlets 63 each having a filter. A slurry inlet pipe 67 positioned on each of the opposite sides of the hatch coaming 50 of the hold externally thereof extends vertically through an upper deck 64 and a slanting wall 66 of an upper wing tank 65. A slurry distributing pipe 68 is positioned at an upper portion of the hold 3 above the outlets 63 on each side and extends substantially horizontally lengthwise of the hold 3. The distributing pipe 68 is fixedly connected to the lower end of the inlet pipe 67 in communication therewith. As seen in FIG. 11, the distributing pipe 68 is in the form of a slender tube of circular cross section and is formed with slurry inlets 69 in its bottom. The distributing pipe 68 may be in the form of a tray as shown in FIG. 12.

With the abvoe transport ship, the coal slurry supplied to each slurry inlet pipe 67 enters the distributing pipe 68 and falls into the hold 3 in the form of a curtain from the inlets 69. Of the coal particles contained in the slurry, those of relatively large sizes quickly settle in the vicinity of the filter-equipped outlets 63 arranged at the bottom of the hold 3 almost immediately below the inlets 69, preventing fine coal particles from reaching the outlets 63 and reducing the likelihood that fine particles will clog up the filters of the outlets 63.

Figure 13:
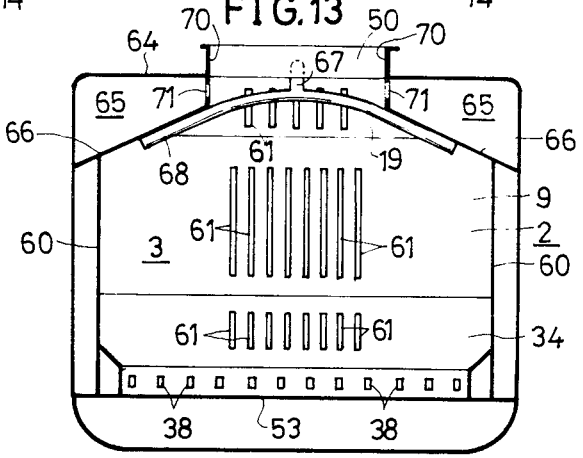
FIG. 13 is a cross sectional view showing another embodiment of the invention.
Figure 14:
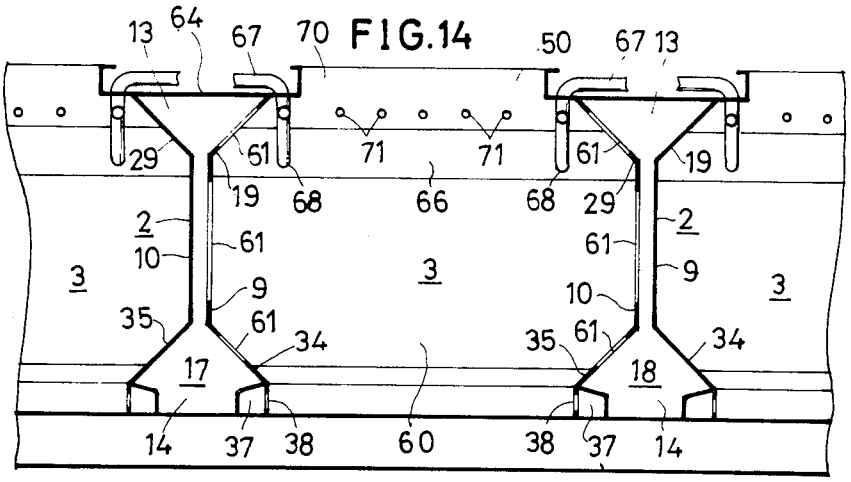
FIG. 14 is a view in longitudinal section showing a hold of the embodiment of FIG. 13.
Figure 15:
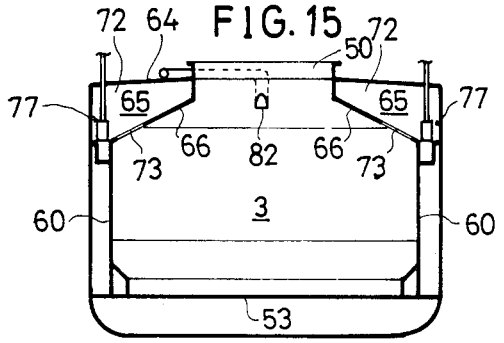
FIG. 15 is a cross sectional view showing another embodiment of the invention.
Figure 16:
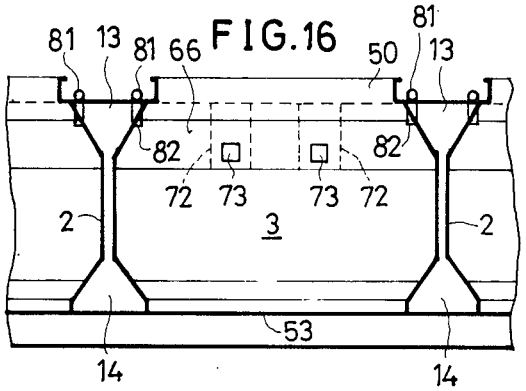
FIG. 16 is a view in longitudinal section showing a hold of the embodiment of FIG. 15.
Figure 17:
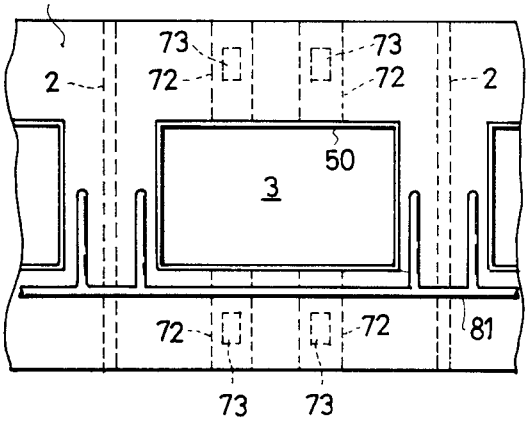
FIG. 17 is a plan view corresponding to FIG. 16.

FIGS. 13 and 14 show another embodiment of the invention, in which the same parts as used in the foregoing embodiments are indicated by the same corresponding reference numerals and will not be described.

The hold 3 of this coal slurry transport ship is provided at its bottom with filter-equipped drain outlets 38 which, as is the case with the embodiment of FIG. 8, are formed in the lower ends of the lower slanting walls 34, 35 of each transverse bulkhead 2. The upper slanting walls 19, 29 of the bulkhead 2 is provided only with overflow drain outlets 61 each having a filter. Each side wall 70 of the hatch coaming 50 is formed in its lower portion with overflow drain outlets 71 in communication with the upper wing tank 65 communicating with the rear drain sumps 18 on the front side of the hold 3 and with the front drain sumps 17 on the rear side of the hold 3. A slurry inlet pipe 67 disposed on each of the front and rear sides of the hatch coaming 50 externally thereof is connected to a slurry distributing pipe 68 extending transversely in a curved form and positioned in an upper portion of the hold 3 above the drain outlets 38.

FIGS. 15 to 19 show another embodiment of the invention, in which the same parts as used in the foregoing embodiments are indicated by the same corresponding reference numerals and will not be described.

Figure 18:
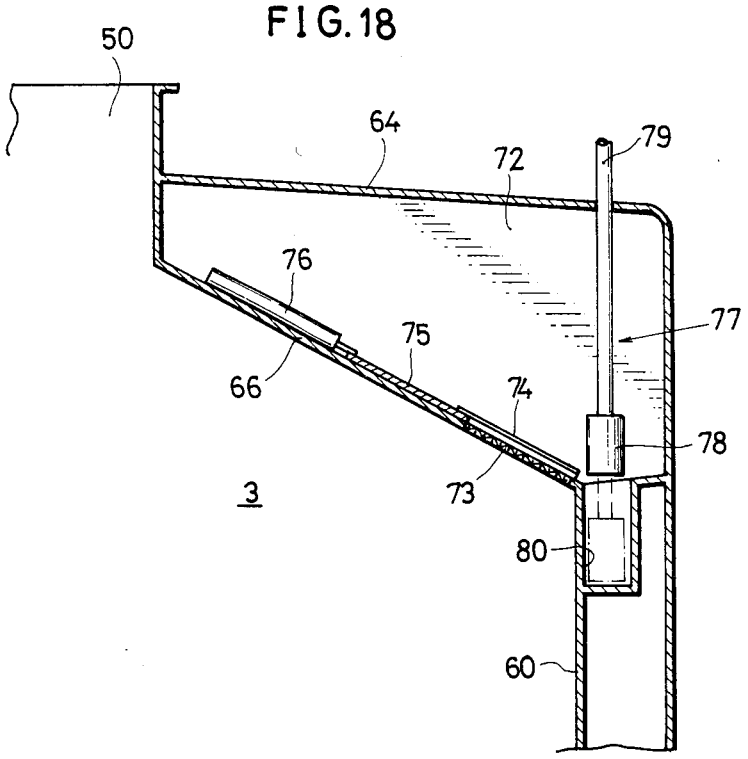
FIG. 18 is an enlarged cross sectional view showing the upper wing tank in FIG. 15.
Figure 19:
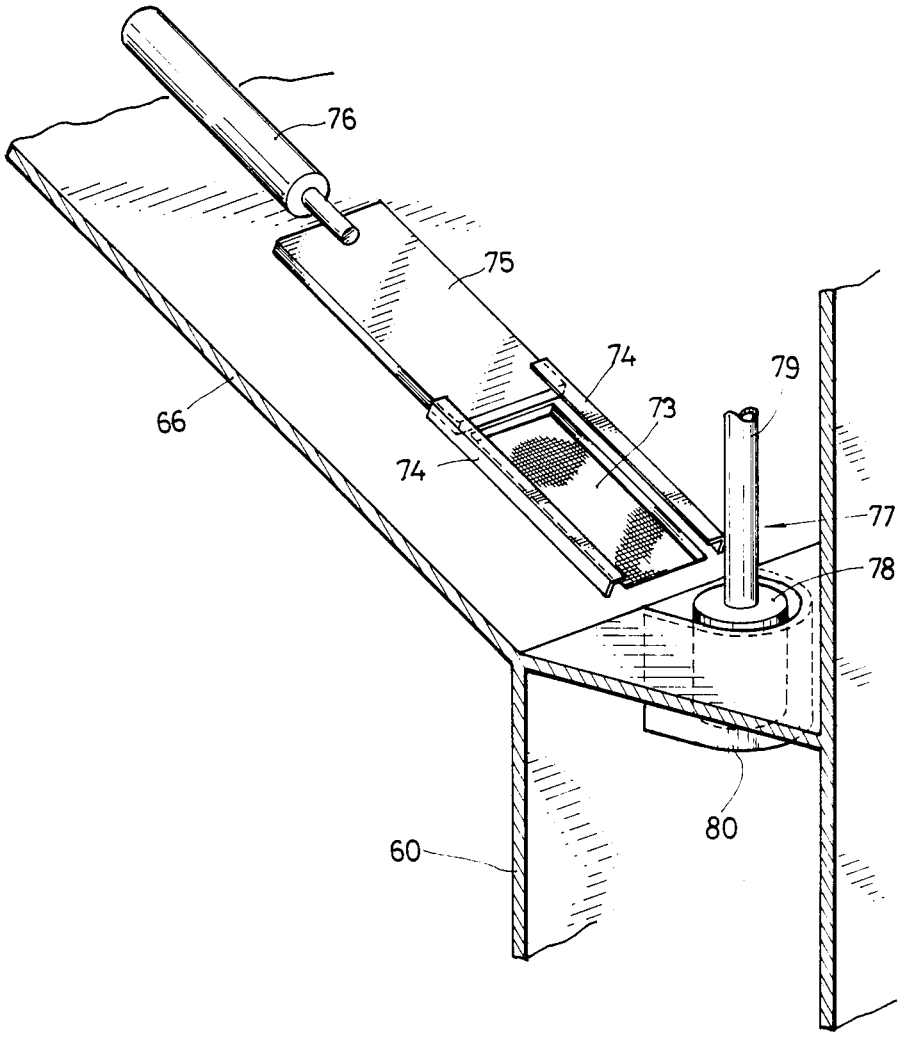
FIG. 19 is a perspective view showing the interior of the upper wing tank of FIG. 18 as it is seen obliquely from above.
Figure 20:
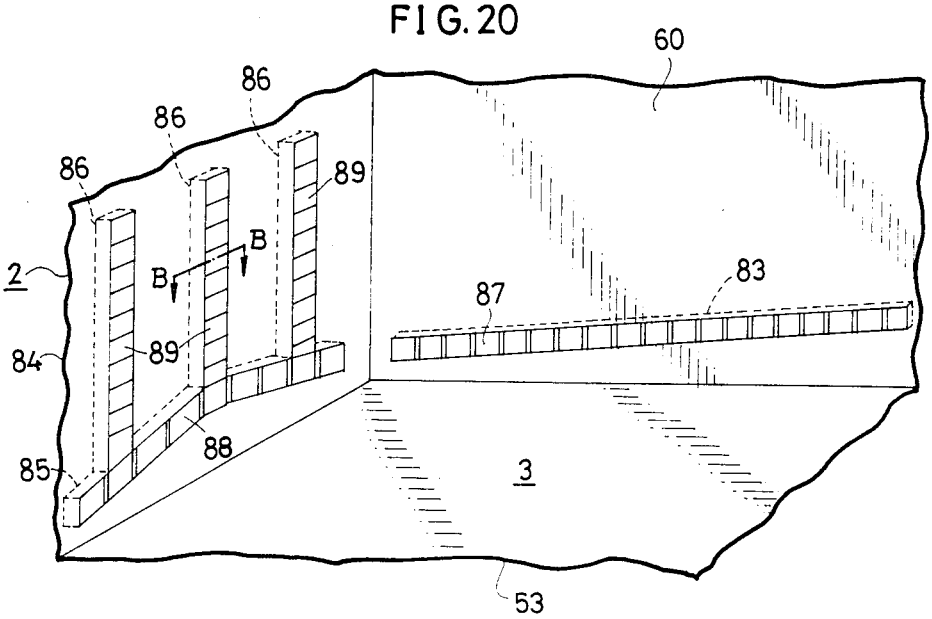
FIG. 20 is a perspective view partly broken away and showing an interior portion of a hold of another embodiment of the invention as it is seen obliquely from the front.
Figure 21:
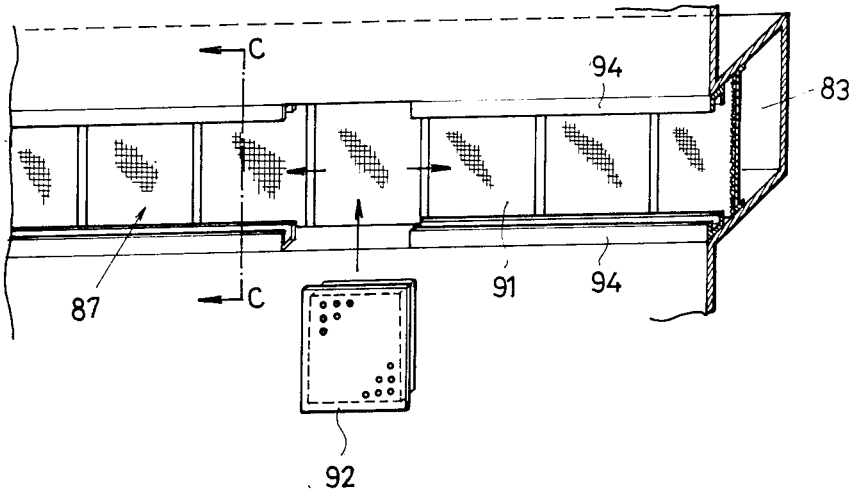
FIG. 21 is a fragmentary perspective view on an enlarged scale of FIG. 20.

Front and rear upper drain sumps 72 are independently provided within the upper wing tank 65 on each side of the hold 3. The upper wing tank 65 has a slanting wall 66 which is formed at a lower portion with an overflow drain outlet 73 having a filter and communicating with each of the sumps 72. As shown in FIGS. 18 and 19, the slanting wall 66 is provided on the upper side thereof with guides 74 positioned on the opposite sides of each overflow drain outlet 73, a shutter 75 for closing the outlet 73 by being guided by the guides 74, and a cylinder 76 for moving the shutter for closing or opening. The upper wing tank 65 is provided with drainage means 77 for the sump 72. The drainage means 77 comprises a drain pump 78 positioned in the sump 72, a drain pipe 79 communicating with the pump and extending through the upper deck 64, etc. and is movable upward or downward in its entirety. The sump 72 has at its bottom a recess 80 positioned at an upper portion of the hold side wall 60 outside thereof. The drain pump 78 is insertable into the recess 80. A slurry inlet pipe 81 disposed on the upper deck 64 extends through the deck on each of the front and rear sides of the hatch coaming 50 outside thereof on the hull center line and has a forward end positioned in an upper portion of the hold 3 and serving as a slurry inlet 82. Although not shown, the hold is provided with filter-equipped drain outlets in specified portions of its bottom and with filter-equipped overflow drain outlets in specified portions of its surrounding walls.

With the above transport ship, the overflow water collecting over the deposit of coal during loading is run off from the hold 3 through the overflow outlets in the surrounding walls of the hold 3 and through the overflow drain outlets 73 in the upper slanting walls 66. The slurry water collecting in the upper drain sumps 72 through the outlets 73 is drawn off by the drainage means 77. The drain pumps 78 are driven automatically.

The shutters 75 for the outlets 73 in the walls 66 are closed when the hold 3 is to be loaded with solids other than the coal slurry, whereby the filters of the drain outlets 73 are prevented from being damaged by the internal pressure of the hold 3.

FIGS. 20 to 27 show another embodiment of the invention, in which the same parts as used in the foregoing embodiments are indicated by the same corresponding reference numerals and will not be described.

Figure 22:
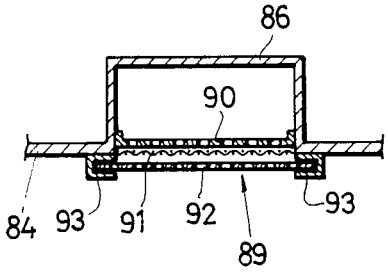
FIG. 22 is an enlarged view in section taken along the line B—B in FIG. 20.
Figure 23:
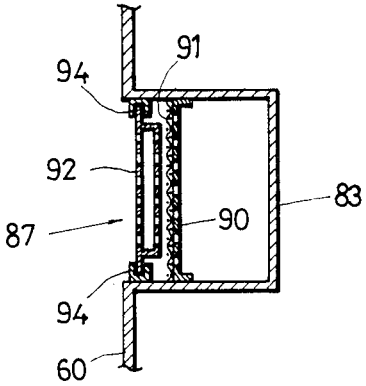
FIG. 23 is a view in section taken along the line C—C in FIG. 21.

The hold 3 shown is provided on the outer side of a lower portion of each side wall thereof with a side drain trunk 83 gently sloped rearwardly downward. An inverted V-shaped rear drain trunk 85 provided on the outer side of a front vertical wall 84 of the rear transverse bulkhead 2 of the hold 3 is gently sloped downward from a central lower portion of the wall 84 toward the opposite sides. Vertical rear drain trunks 86 communicating at their lower ends with the inverted trunk 85 extend approximately over the entire height of the wall 84. The drain trunks 83, 85, 86 are formed in the walls thereof facing the hold with drain outlets 87, 88, 89 in communication with the interior of the hold 3 and each having a filter. As seen in FIGS. 22 and 23, the filter comprises a perforated plate 90 of vinyl chloride resin attached to the outlet portion 87, 88 or 89 for closing the outlet, a sheet of metal netting 91 attached to the side of the plate 90 facing the hold 3, and a perforated steel plate 92 removably attached to the outlet portion and directly facing the hold 3. The perforated steel plate 92 for the vertical drain trunk 86 is of single construction and inserted from above between a pair of guides 93 on the opposite sides of the outlet 89. The perforated steel plate 92 for the side trunk 83 as well as for the inverted trunk 85 is of double construction and guided and supported by a pair of upper and lower guides 94 provided for the outlets 87 or 88. The guides 94 are partly cut out, and the plate 92 is inserted between the guides 94 at the cutout portions.

The water of coal slurry placed into the hold 3 passes through the steel plates 92, sheets of netting 91 and resin plates 90 of the outlets 87, 88 and 89, collects in the drain trunks 83, 85 and 86 and is drained. The slurry water passing through the perforated steel plate 92 contains a small amount of fine coal particles, which are effectively removed by the netting 91 and remain in the space between the plate 92 and the netting 91, permitting the slurry water only to collect in the trunks 83, 85, 86. Since the side trunks 83 and the inverted V-shaped trunk 85 are sloped, the fine particles remaining in the space between the plate 92 and the netting 91 are easily forced out along the slope by the movement of slurry water when a slurry is loaded into the hold the next time.

The use of the perforated resin plate 90 for supporting the metal netting 91 renders the filter lightweight, inexpensive and easy to install and remove and inhibits the corrosion of the metal netting 91.

Figure 24:
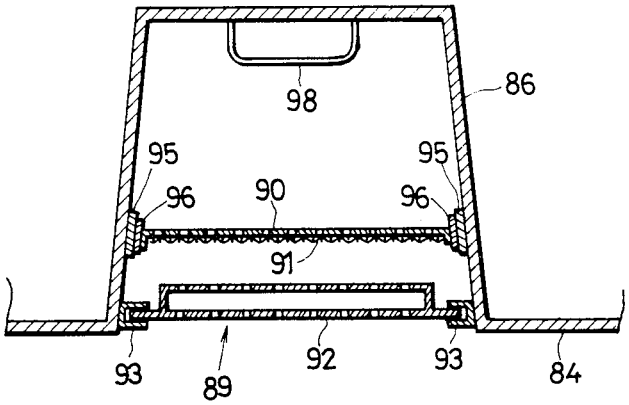
FIG. 24 is a view in horizontal section showing modified drain trunk and drain outlet equipped with a filter which are included in the embodiment of FIG. 20.
Figure 27:
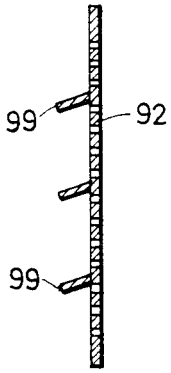
FIG. 27 is a view in section taken along the line D—D in FIG. 26.
Figure 25:
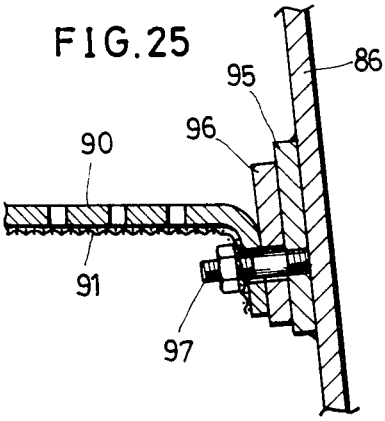
FIG. 25 is a fragmentary enlarged view in horizontal section of FIG. 24.
Figure 26:
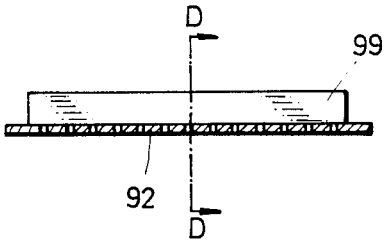
FIG. 26 is a view in horizontal section showing a modified perforated plate for the drain outlet of FIG. 24.
Figure 28:
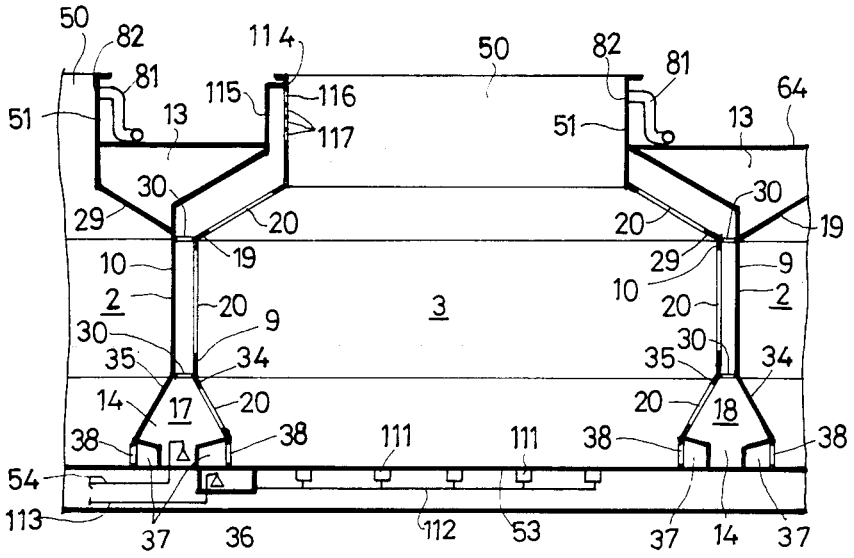
FIG. 28 is a view in longitudinal section showing a hold of another embodiment of the invention.
Figure 29:
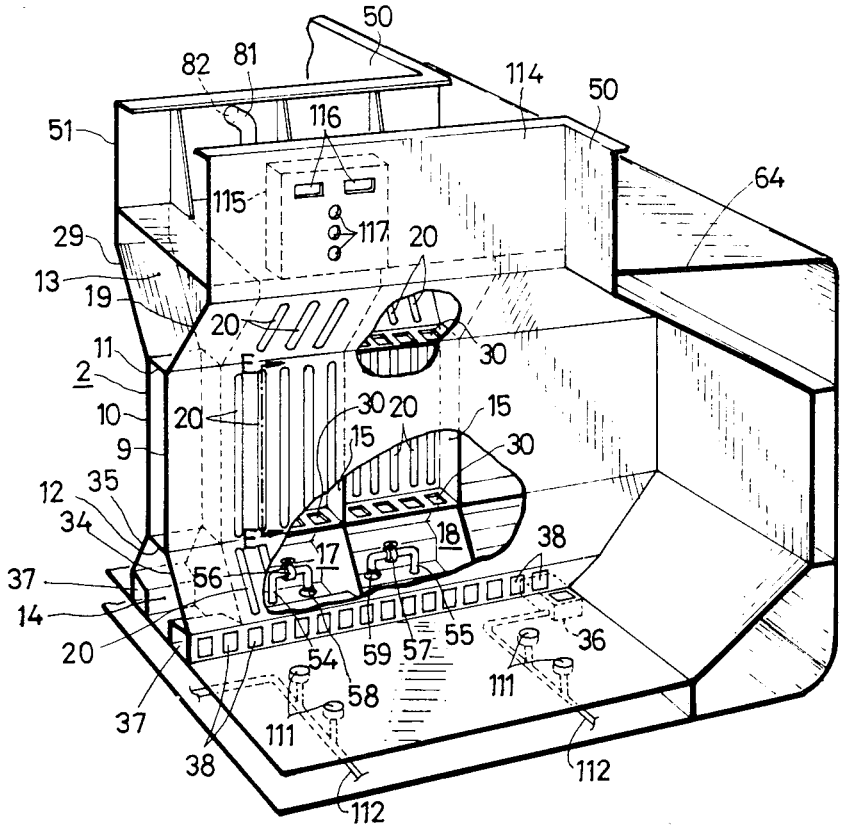
FIG. 29 is a perspective view partly broken away and showing an interior portion of a hold of the embodiment of FIG. 28 as it is seen obliquely from the front.

FIGS. 24 and 25 show modifications of the vertical drain trunk 86 and the filter of the outlet 89 thereof. The perforated vinyl chloride resin plate 90 and the netting 91 are fixed to seats 95 on the opposite side walls of the trunk 86 by bolts 97 with an interposed rubber packing 96. The perforated steel plate 92 is of double construction. Ascending steps 98 are attached to the inner side of the rear wall of the trunk 86. FIGS. 26 and 27 show a perforated steel plate 92 in the form of a single plate having slanting ribs 99 on one side thereof facing the hold 3.

FIGS. 28 to 31 show another embodiment of the invention, in which the same parts as used in the foregoing embodiments are indicated by the same corresponding reference numerals and will not be described.

Figure 30:
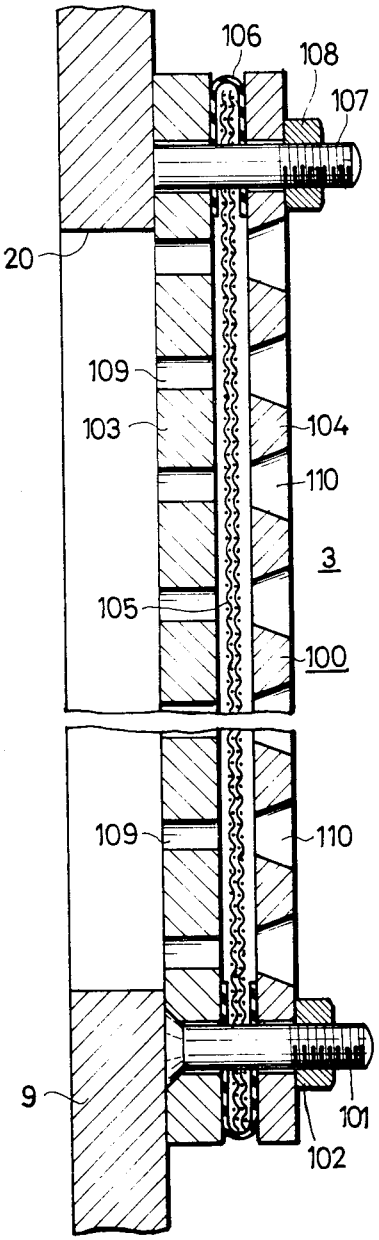
FIG. 30 is a fragmentary enlarged view in section taken along the line E—E in FIG. 29.
Figure 31:
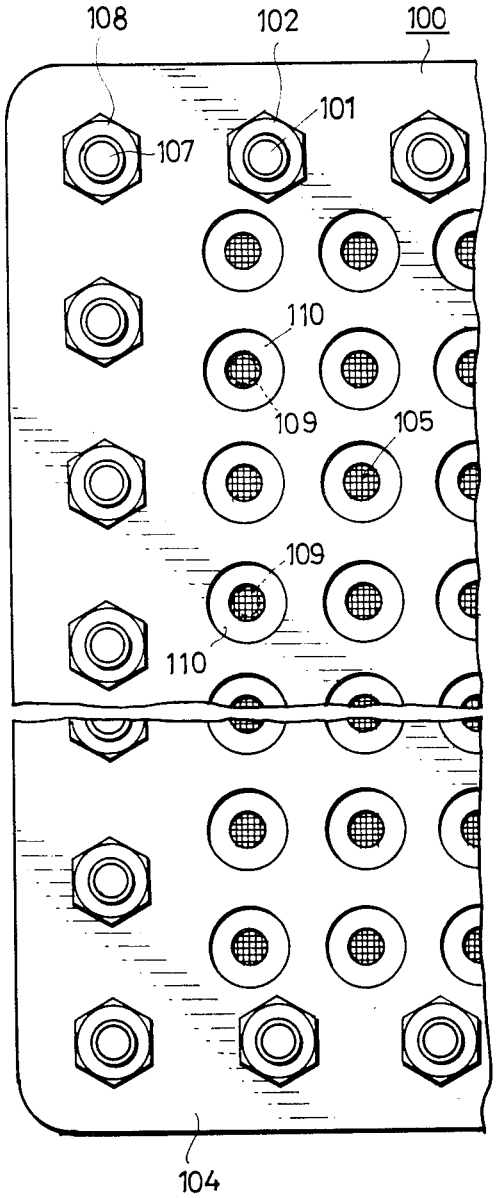
FIG. 31 is a right side elevation of FIG. 30.

The front and rear transverse bulkheads 2 defining the hold 3 of the ship are each internally provided with front drain sumps 17 and rear drain sumps 18 on either side of the hull center line. As seen in FIGS. 30 and 31, each of filters 100 for overflow drain outlets 20 communicating with the sumps 17 or 18 comprises two perforated plates 103, 104 connected together by large numbers of bolts 101 and nuts 102 at their outer peripheral portions, and two sheets of metal netting 105 sandwiched between these plates 103, 104. The entire outer peripheral portion of the netting 105 having the bolts 101 extending therethrough is covered with a rubber packing 106. A suitable number of bolts 107 fixed to the wall defining the outlet 20 perpendicular thereto on the front side thereof extend through the outer peripheral portion of the filter 100, which is fastened to the wall by nuts 108 screwed on the bolts 107 to cover the outlet 20. The perforated plate 103 adjacent the wall is formed with a large number of circular parallel perforations 109. The perforated plate 104 facing the hold 3 is formed with a large number of circular tapered perforations 110 flaring toward the hold 3 and substantially concentric with the parallel perforations 109. The smaller opening of the tapered perforation 110 is about twice as large as the opening of the perforation 109 in area. The front and rear lower slanting walls 34, 35 of the bulkhead 2 are provided at their lower ends with filter-equipped drain outlets 38 communicating through drain trunks 37 with bilge wells 36 under the hold bottom plate 34. The bottom plate 34 is provided with drain outlets 111 having a filter and communicating with the bilge well 36 through a drain pipe 112. The well 36 has a drain pipe 113 of a system different from the system including the drain pipes 54, 55 for the sumps 17, 18. The filter for the outlet 38 or 111 has the same construction as the filter 100 of the outlet 20. The hatch coaming 50 of the hold 3 is higher than those of usual cargo ships. The rear wall 114 of the hatch coaming 50 above the front drain sump 17 is externally provided with a drain trunk 115 communicating with the sump 17. The coaming rear wall 114 provided with the trunk 115 is formed in an upper portion with overflow drain outlets 116 communicating with the trunk 115. Closable free water drain outlets 117 communicating with the trunk 115 are formed in the wall 114 below the outlets 116. A slurry inlet pipe 81 on the upper deck 64 of the ship has a slurry inlet 82 in an upper portion of the front wall 51 of the hatch coaming 50.

When a coal slurry is continuously placed into the hold 3 through the inlet 82, the coal particles in the slurry settle, permitting part of the slurry water to collect above the deposit of the coal. The water is rapidly drawn off through the front and rear overflow outlets 20 of the hold 3, collected in the sumps 17, 18 and returned ashore by an unillustrated drain pump. The free water outlets 117 in the coaming 50 are closed during loading. The overflow water is drained first through the outlets 20 in the lower portion, then through the outlets 20 in the upper portion as the amount of coal particles in the hold increases and finally through the overflow outlets 116 in the coaming 50. Since the overflow outlets 116 of the coaming 50 are provided with no filter, the overflow water can be drawn off properly through the outlets 116 even if the outlets 20 of the hold 3 have their filters clogged up. If the drain pumps are operated incessantly during loading to immediately discharge the overflow water, coal particles will settle below the slurry inlet 82 to form an accumulation and will not reach the corners of the hold 3. Accordingly the pumps are operated intermittently during loading to effectively cause the coal particles to flow to the corners, whereby the hold can be loaded with coal particles uniformly up to the level of the hatch coaming 50. When the ship rolls or pitches markedly due to the weather condition, coal particles can be distributed uniformly throughout the interior of the hold 3 without the necessity of intermittently driving the drain pumps. If the overlying slurry water is present inside the coaming 50 when the loading is completed, the outlets 117 are opened to drain the water.

The slurry water remaining between the coal particles thus loaded into the hold 3 is partly drawn off through the outlets 38, 111 in the lower ends of the lower slanting walls 34, 35 and in the hold bottom wall 53 during navigation. The coal transported is unloaded with a grab.

Although not shown, the hold 3 is internally provided with filter cleaning nozzles at suitable locations, through which high-pressure water is forced against the filters 100 of the overflow drain outlets 20 and the outlets 38, 111 for cleaning. Since the perforated plate 104 of the filter 100 facing the hold 3 has the tapered perforations 110 flaring toward the hold 3, the coal particles clogging the perforations can be readily washed away with the water forced out from the nozzle. Further because the smaller openings of the tapered perforations 110 are larger than the openings of the parallel perforations 109 of the plate 103 adjacent the wall, the water can be fully passed via the perforations even if the tapered perforations 110 are clogged with coal particles to some extent during loading, hence a reduced likelihood of clogging. Because the netting 105 is fixedly sandwiched between the two perforated plates 103, 104 and further because the overall opening area of the parallel perforations 109 of the plate 103 not facing the hold 3 is reduced to a minimum needed for passing water therethrough, the load to be exerted on the netting 105 by the coal slurry can be reduced. This decreases the likelihood of damage to the netting 105.

Since the ship shown in FIGS. 28 to 31 is provided with the filter-equipped overflow drain outlets 20 in the front and rear portions of the hold 3, the structure is suited especially when the hold has a relatively large length.

Figure 32:
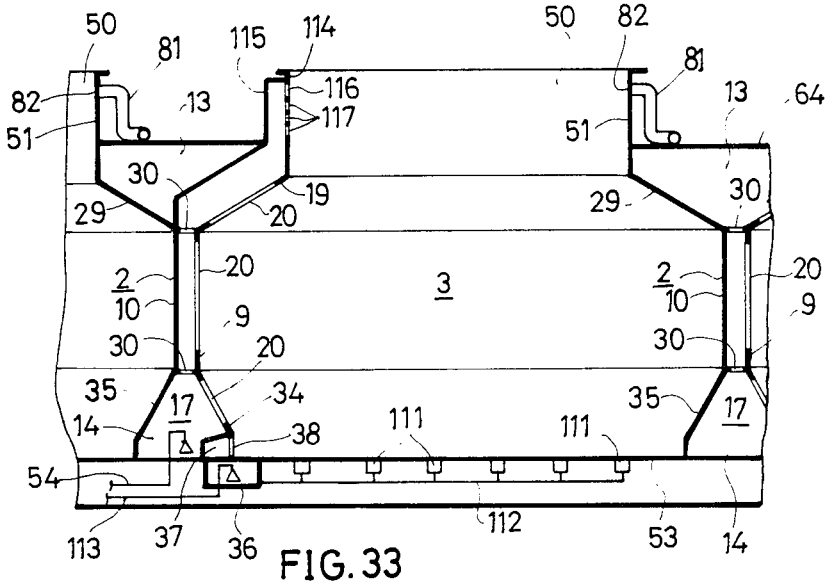
FIG. 32 is a view in longitudinal section showing a hold of another embodiment of the invention.
Figure 33:
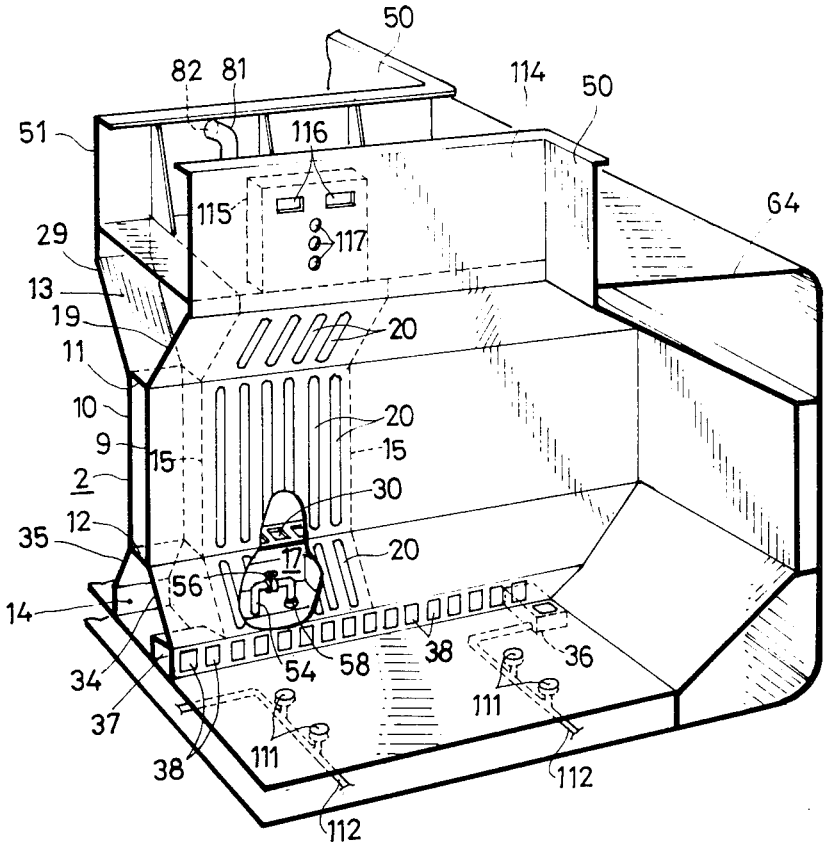
FIG. 33 is a perspective view partly broken away and showing an interior portion of a hold of the embodiment of FIG. 32 as it is seen obliquely from the front.

FIGS. 32 and 33 show another embodiment of the invention, in which the same parts as used in the foregoing embodiments are indicated by the same corresponding reference numerals and will not be described.

The transverse bulkhead 2 of the ship is internally provided only with a front drain sump 17. Filter-equipped overflow drain outlets 20 communicating with the sump 17 are formed only in the rear walls 19, 9, 34 of the hold 3. Filter-equipped drain outlets 38 are also formed in a rear portion of the hold 3 only, i.e. only in the lower slanting wall 34 on the front side of the bulkhead 2.

A coal slurry is loaded into the ship in the same manner as is the case with the embodiment of FIGS. 28 to 31. The overflow water collecting above the mass of coal particles during loading is rapidly drawn off through the filter-equipped overflow outlets 20 in the rear portion of the hold 3 opposite to the slurry inlet 82.

The arrangement shown in FIGS. 32 and 33 and having the outlets 20 only in the rear portion of the hold is suitable when the hold 3 has a relatively large width or is nearly square to build the ship at a reduced cost.

Figure 34:
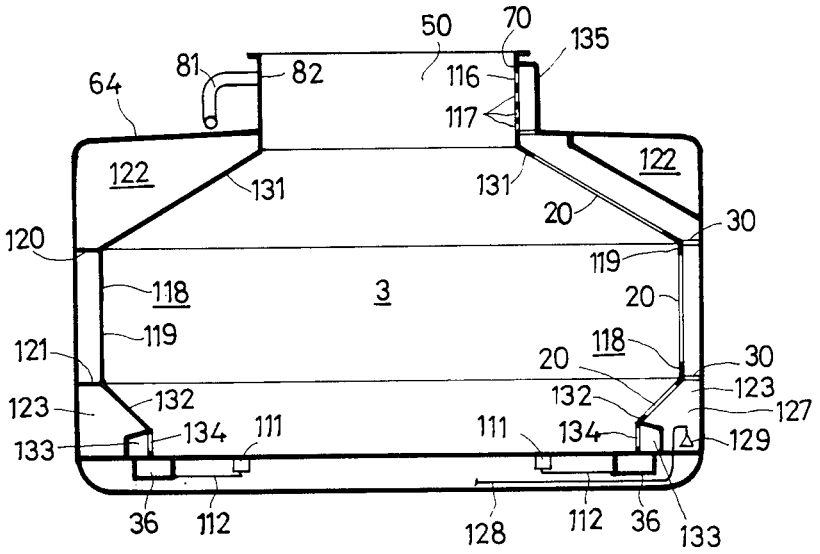
FIG. 34 is a cross sectional view showing another embodiment of the invention.
Figure 35:
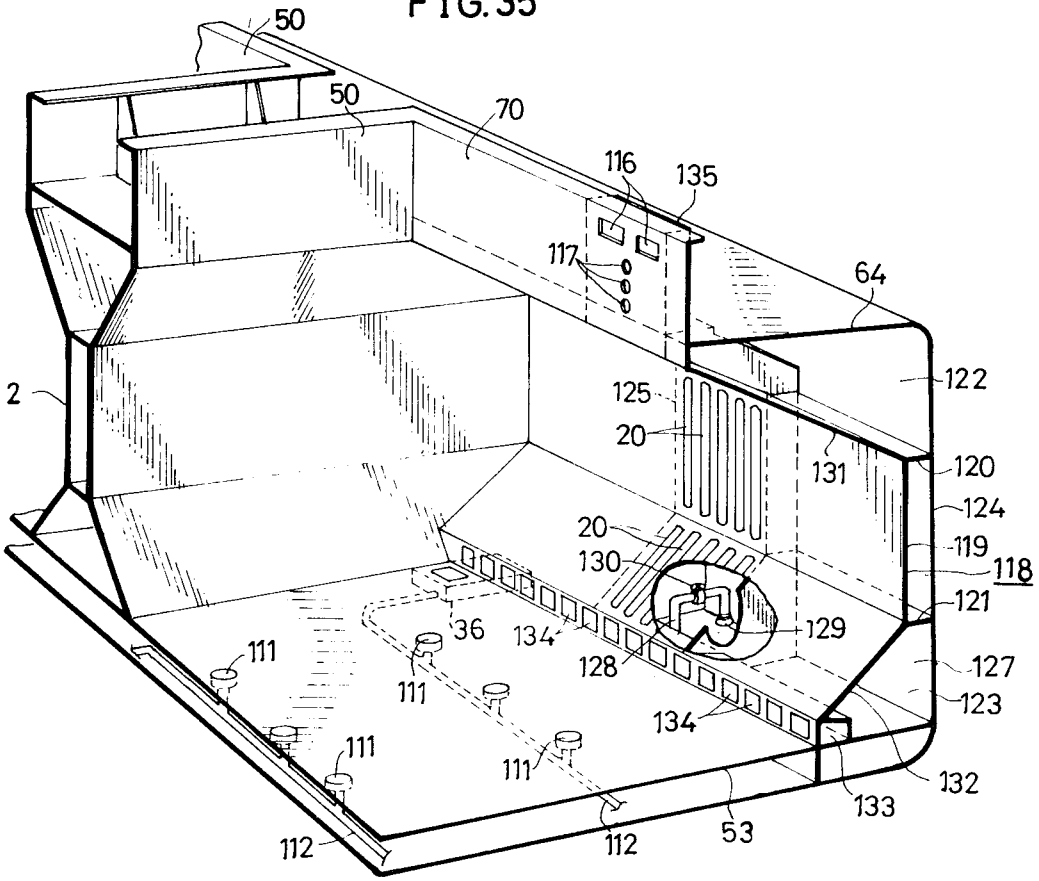
FIG. 35 is a perspective view partly broken away and showing an interior portion of a hold of the embodiment of FIG. 34 as it is seen obliquely from the front.

FIGS. 34 and 35 show another embodiment of the invention, in which the same parts as used in the foregoing embodiments are indicated by the same corresonding reference numerals and will not be described.

Each side wall 118 of the hold 3 includes an intermediate vertical wall 119, above and below which there are wing tanks 122, 123 partitioned by horizontal walls 120, 121. The space between the intermediate vertical wall 119 and the outer plate 124 of the hull on one side of the ship, and the upper and lower wing tanks 122, 123 above and below the space are each divided by vertical walls 125 into sections arranged longitudinally of the ship. In one section in the middle of the length of the hold, the horizontal walls 120, 121 are formed with openings 30. The interior space of the lower wing tank 123 in this section serves as a sump 127 for containing the drain from the hold 3. The drain sump 127 is internaly provided with a drain pipe 128 for returning overflow water ashore. The pipe 128 has a bell mouth 129 at its forward end and a valve 130 at an intermediate portion thereof. A plurality of vertically elongated filter-equipped overflow drain outlets 20 communicating with the sump 127 are formed in each of an upper slanting wall 131, the intermediate wall 119 and a lower slanting wall 132. The outlets 20 extend substantially over the entire height of each wall. The lower slanting walls 132 included in the opposite side walls 118 of the hold are provided at their lower ends with drain trunks 133 in communication with bilge wells 36 under the hold bottom wall 53. The walls of the trunks 133 facing the hold 3 are formed with filter-equipped drain outlets 134. The hatch coaming 50 has a side wall 70 above the sump 127 which wall is externally provided with a drain trunk 135 communicating with the sump 127. The side wall 70 covered with the trunk 135 is provided with overflow drain outlets 116 positioned at an upper portion and communicating with the trunk 135 and closable free water drain outlets 117 positioned below the outlets 116 and communicating with the trunk 135. A slurry inlet pipe 81 on the upper deck 64 has a slurry inlet 82 in an upper portion of the other side wall 70 of the coaming 50 opposite the outlets 116.

A coal slurry is loaded into the ship in the same manner as is the case with the embodiment of FIGS. 28 to 31. The overflow water collecting above the mass of coal particles during loading is rapidly drained via the filter-equipped overflow outlets 20 on one side of the hold 3 opposite the slurry inlet 82.

The arrangement shown in FIGS. 34 and 35 and having the overflow outlets 20 in only one side wall 118 of the hold 3 is especially suitable when the hold has a relatively large length to provide the ship at a low cost.

Figure 36:
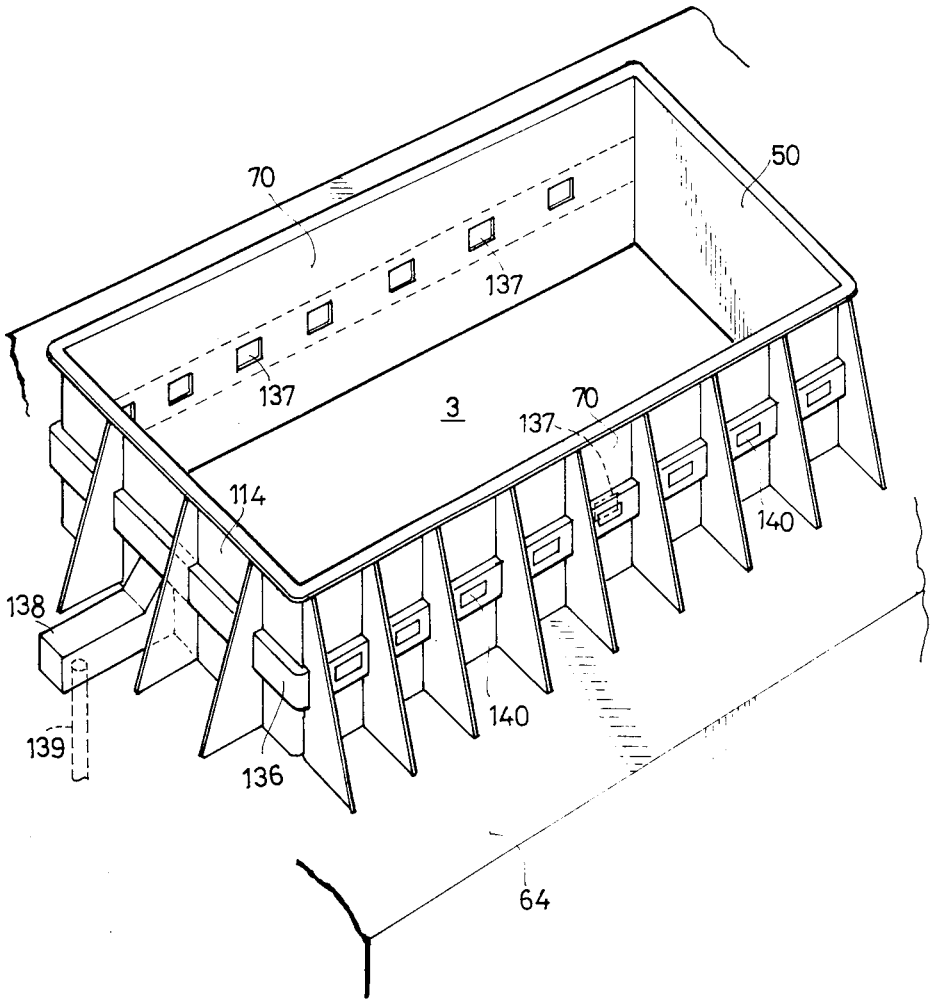
FIG. 36 is a perspective view showing a hold of another embodiment of the invention as it is seen obliquely from above.

FIG. 36 shows another embodiment of the invention, wherein the same parts as used in the foregoing embodiments are indicated by the same corresonding reference numerals and will not be described.

The hatch coaming of the hold 3 of the ship has opposite side walls 70 and a rear wall 114 which are externally provided with a continuous drain trunk 136. The side walls 70 are provided with filter-equipped overflow drain outlets 137 communicating with the trunk 136, which in turn is in communication with an unillustrated drain sump within the transverse bulkhead via a drain duct 138 and a drain pipe 139. In corresponding relation to the outlets 137, the outer wall of the trunk 136 is formed with openings each having a watertight cover 140 for inspecting and cleaning the filter.

Figure 37:
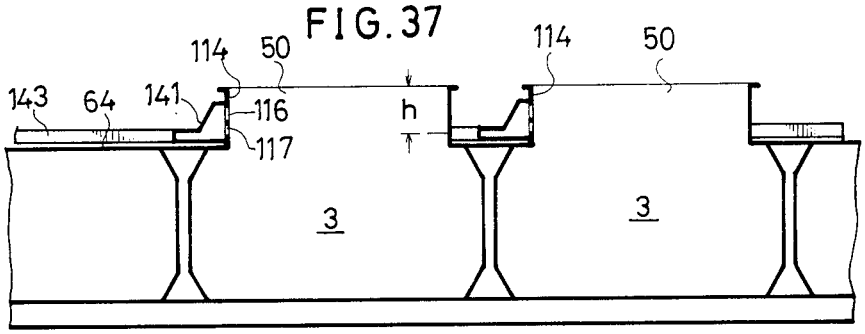
FIG. 37 is a view in longitudinal section showing a hold of another embodiment of the invention.
Figure 38:
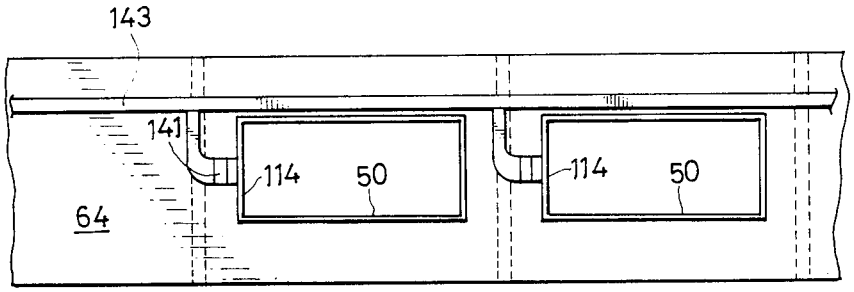
FIG. 38 is a plan view corresopnding to FIG. 37.
Figure 39:
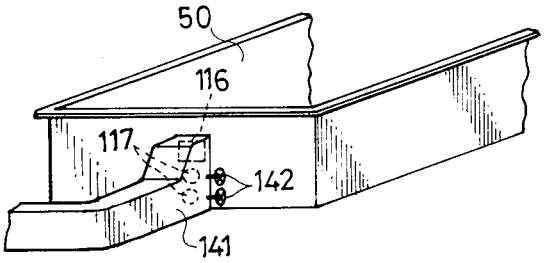
FIG. 39 is a fragmentary enlarged perspective view of FIG. 38.

FIGS. 37 to 39 show another embodiment of the invention, wherein the same parts as used in the foregoing embodiments are indicated by the same corresponding reference numerals and will not be described.

The ship is an existing cargo ship which is modified to provide holds 3 of increased capacity. The hatch coaming of the cargo ship is extended by a height h to provide a coaming 50. A drain trunk 141 is provided on the upper deck 64 outside the rear wall 114 of the coaming. The rear wall 114 covered with the trunk 141 has an overflow drain outlet 116 and free water drain outlets 117 communicating with the trunk 141. The outlets 117 are opened or closed by valves 142 which can be handled from outside the trunk 141. The trunk 141 communicates with an unillustrated drain sump provided in a suitable interior portion of the ship, via a drain pipe 143. Although not shown filter-equipped drain outlets are formed in specified portions of the hold bottom. Filter-equipped overflow drain outlets are also formed in specified portions of the wall defining the hold.

What is claimed is:

1. A ship for transporting a coal slurry comprising:

a plurality of holds with adjacent holds being partitioned by a pair of transverse bulkheads;

a plurality of sections formed in the interior space between the two bulkheads of each of said pair by longitudinal partitions;

including a pump room section, a front drain sump section and a rear drain sump section disposed in said interior space and independent from each other;

filter-equipped drain outlets formed substantially over the entire height of the front wall of the front drain sump and of the rear wall of the rear drain sump;

a slurry container provided under the bottom wall of the hold for collecting a slurry from the bottom of the hold during loading; and a pump means provided in said pump room in between said transverse bulkheads for discharging the slurry water from the drain sumps within said transverse bulkheads and also for discharging the coal slurry from the slurry container.

* * * * *